US010087820B2

(12) United States Patent
Uesugi et al.

(10) Patent No.: US 10,087,820 B2
(45) Date of Patent: Oct. 2, 2018

(54) TURBOCHARGER

(71) Applicants: KABUSHIKI KAISHA TOYOTA JIDOSHOKKI, Kariya-shi, Aichi-ken (JP); TOYOTA JIDOSHA KABUSHIKI KAISHA, Toyota-shi, Aichi-ken (JP)

(72) Inventors: Tsuyoshi Uesugi, Kariya (JP); Koichi Yonezawa, Toyota (JP)

(73) Assignees: KABUSHIKI KAISHA TOYOTA JIDOSHOKKI, Kariya-shi, Aichi-ken (JP); TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 387 days.

(21) Appl. No.: 15/071,433

(22) Filed: Mar. 16, 2016

(65) Prior Publication Data

US 2016/0273551 A1 Sep. 22, 2016

(30) Foreign Application Priority Data

Mar. 18, 2015 (JP) ..... 2015-055107

(51) Int. Cl.
*F02B 33/40* (2006.01)
*F04D 29/42* (2006.01)
(Continued)

(52) U.S. Cl.
CPC ..... *F02B 33/40* (2013.01); *F02B 39/005* (2013.01); *F02G 5/00* (2013.01); *F04D 29/4206* (2013.01);
(Continued)

(58) Field of Classification Search
CPC ..... Y02T 10/144; Y02T 10/16; F01D 25/14; F01D 25/12; F01D 9/026; F02M 26/23;
(Continued)

(56) References Cited

U.S. PATENT DOCUMENTS 6,513,328 B2 * 2/2003 Baeuerle ..... F01D 25/14 60/599
7,056,103 B2 * 6/2006 LaRue ..... F01D 25/125 415/4.3
(Continued)

FOREIGN PATENT DOCUMENTS

JP 2003035153 A 2/2003
JP 2006-161689 A 6/2006
(Continued)

OTHER PUBLICATIONS

Communication dated Apr. 4, 2017 from the Japanese Patent Office in counterpart Application No. 2015-055107.
(Continued)

*Primary Examiner* — Eldon Brockman
(74) *Attorney, Agent, or Firm* — Sughrue Mion, PLLC

(57) ABSTRACT

A turbocharger includes a cooling passage. The cooling passage extends along a diffuser surface. Fluid for cooling the diffuser surface flows through the cooling passage. The turbocharger includes a water jacket, which is arranged at a connection portion between a blow-by gas recirculation passage and an intake passage. Coolant for warming blow-by gas flows through the water jacket. The cooling passage communicates with the water jacket. Coolant that has been drawn into the cooling passage flows through the water jacket after flowing through the cooling passage.

5 Claims, 3 Drawing Sheets

(51) Int. Cl.
*F04D 29/58* (2006.01)
*F02G 5/00* (2006.01)
*F02B 39/00* (2006.01)

(52) U.S. Cl.
CPC ..... *F04D 29/584* (2013.01); *F01P 2060/12* (2013.01); *F05D 2220/40* (2013.01)

(58) Field of Classification Search
CPC ..... F02M 26/34; F02M 26/06; F02M 26/51; F02B 33/40; F02B 39/005; F02G 5/00; F04D 29/584; F04D 29/4206; F01P 2060/12; F05D 2220/40
See application file for complete search history.

(56) References Cited

U.S. PATENT DOCUMENTS 8,365,526 B2 * 2/2013 Stiermann ..... F01D 25/14 60/599
9,303,650 B2 * 4/2016 Ulrey ..... F02B 37/00
9,546,568 B2 * 1/2017 Kanzaka ..... F01D 25/125
9,784,124 B2 * 10/2017 Oki ..... F01D 25/12
2002/0029570 A1 * 3/2002 Baeuerle ..... F01D 25/14 60/616
2014/0377059 A1 * 12/2014 Ulrey ..... F02B 37/00 415/205
2015/0176429 A1 * 6/2015 Oki ..... F01D 25/12 415/175

FOREIGN PATENT DOCUMENTS

JP 2010-209846 A 9/2010
JP 2012-2192 A 1/2012
JP 5359403 B2 12/2013
JP 2014-159746 A 9/2014
JP 2014202171 A 10/2014

OTHER PUBLICATIONS

Communication dated Jan. 26, 2018 from the State Intellectual Property Office of the P.R.C. in counterpart Chinese application No. 201610143532.X.

* cited by examiner

TURBOCHARGER

BACKGROUND OF THE INVENTION

The present invention relates to a turbocharger.

Conventionally, turbochargers have been used, which utilizes kinetic energy of exhaust gas discharged by internal combustion engines to supercharge air to the engines. A typical turbocharger includes a turbine located in the exhaust system of an internal combustion engine and a compressor located in the intake system of the engine. When drawn into the turbine, exhaust gas discharged by the engine rotates the turbine impeller in the turbine. The turbine impeller is coupled to a compressor impeller located in the compressor. Thus, rotation of the turbine impeller rotates the compressor impeller. When the compressor impeller rotates, air drawn in through the compressor inlet is compressed and then delivered to the diffuser passage arranged outward of the compressor impeller. The air is subsequently delivered to a scroll passage. The supply of compressed from the compressor to the internal combustion engine improves the performance of the engine.

The compressor inlet is connected to the intake passage. Blow-by gas leaked from the internal combustion engine is drawn into the intake passage via a blow-by gas recirculation passage. Blow-by gas contains lubricating oil and fuel. The air drawn in by the compressor is compressed to become high-pressure compressed air. This increases the temperature of a wall surface that faces the diffuser passage, that is, the diffuser surface, through which the compressed air flows. Droplets containing oil as a main component are solidified at temperatures higher than or equal to, for example, 160° C. Thus, oil and the like are solidified and accumulated on the diffuser surface. Accumulation of oil and the like reduces the area of the diffuser passage, reducing the performance and operating characteristics of the turbocharger.

Japanese Patent No. 5359403 discloses a configuration in which a cooling passage is provided in the wall of a compressor housing member. Fluid that flows through the cooling passage cools the diffuser surface, thereby lowering the temperature of the diffuser surface. Accordingly, the temperature of the diffuser surface is kept lower than the temperature at which oil and the like are solidified. This limits solidification of oil and the like on the diffuser surface.

In the above described conventional configuration, when blow-by gas is drawn into the intake passage, water vapor in the blow-by gas freezes depending on the temperature of the air drawn into the compressor, and the ice may damage the compressor impeller. Japanese Laid-Open Patent Publication No. 2012-2192 discloses a configuration in which an intake passage has, for example, a heating passage such as a water jacket. Coolant for cooling the internal combustion engine flows through the heating passage. The temperature of the coolant is approximately 80° C., which is relatively high. Thus, the coolant flowing through the heating passage heats a part of the intake passage in the vicinity of the section for introducing blow-by gas. This limits freezing of water vapor in the vicinity of the blow-by gas introducing section. Therefore, damage to the compressor impeller by ice is limited.

Accordingly, there has been a demand for a configuration that effectively limit solidification of oil and the like contained in blow-by gas and freezing of water vaper contained in blow-by gas, without increasing the size of a turbocharger.

SUMMARY OF THE INVENTION

It is an objective of the present invention to provide a turbocharger that effectively limits solidification of oil and the like contained in blow-by gas and freezing of water vaper contained in blow-by gas, without increasing the size.

To achieve the foregoing objective and in accordance with one aspect of the present invention, a turbocharger is provided that includes a compressor housing member having a compressor chamber, a compressor impeller accommodated in the compressor chamber, an intake port, which communicates with the compressor chamber, a diffuser passage, which communicates with the compressor chamber and has a shape surrounding the compressor chamber, a diffuser surface, which faces the diffuser passage, a cooling passage, an intake passage, a blow-by gas recirculation passage, and a heating passage. The cooling passage extends along the diffuser surface. A fluid for cooling the diffuser surface flows through the cooling passage. The intake passage communicates with the intake port. The blow-by gas recirculation passage draws in blow-by gas to the intake passage. The heating passage is provided at a connection portion between the blow-by gas recirculation passage and the intake passage. A fluid for warming the blow-by gas flows through the heating passage. The cooling passage communicates with the heating passage. The fluid that has been drawn into the cooling passage flows to the heating passage after flowing through the cooling passage.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
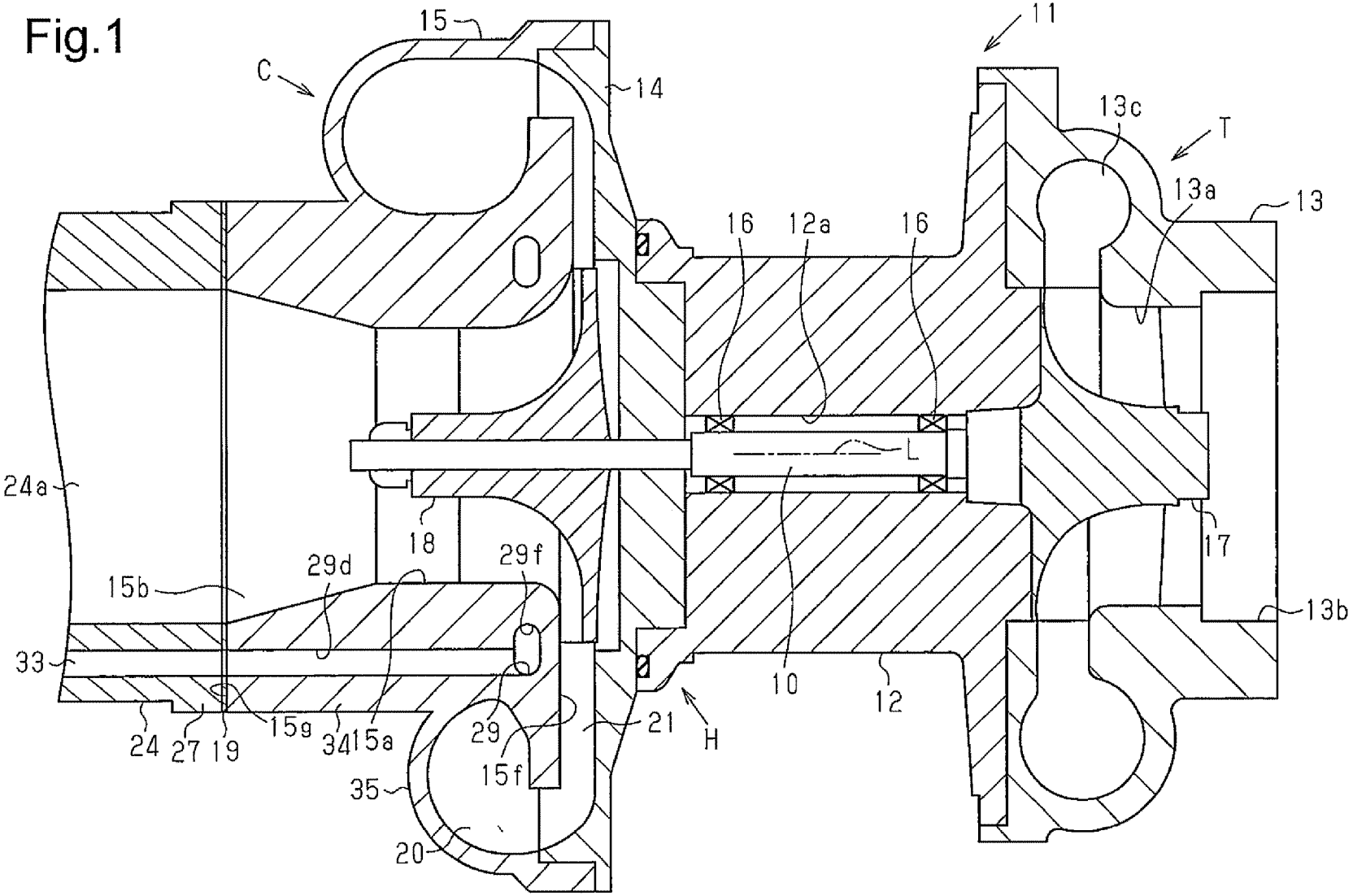
FIG. 1 is a cross-sectional view illustrating a turbocharger according to one embodiment of the present invention.

A turbocharger 11 according to one embodiment of the present invention will now be described with reference to FIGS. 1 to 4. The turbocharger 11 is mounted on a vehicle and employed for an on-vehicle internal combustion engine (hereinafter, referred to as an internal combustion engine). The turbocharger 11 is a forced induction device that utilizes the energy of exhaust of the internal combustion engine to compress intake air and supplies compressed air to the internal combustion engine. In the following description of the turbocharger 11, the left side and the right side as viewed in FIG. 1 are defined as the front side and the rear side, respectively. In addition, the direction in which a central axis L of an impeller shaft 10 (described later) extends is defined as the axial direction, and the direction that intersects the central axis L at right angle is defined as the radial direction.

As shown in FIG. 1, a housing H of the turbocharger 11 includes a bearing housing member 12, a turbine housing member 13 coupled to the rear end of the bearing housing member 12, and a compressor housing member 15 coupled to the front end of the bearing housing member 12 with a seal plate 14 in between. The bearing housing member 12 has a central axis. The turbocharger 11 includes a turbine T arranged in the turbine housing member 13 and a compressor C arranged in the compressor housing member 15. The turbine T is arranged in the exhaust passage (not shown) of the internal combustion engine, and the compressor C is arranged in the intake passage (not shown) of the internal combustion engine.

The bearing housing member 12 has a shaft hole 12*a*, which extends through the bearing housing member 12 in the axial direction. The impeller shaft 10 is rotationally supported in the shaft hole 12*a* via bearings 16. The turbocharger 11 includes a turbine impeller 17, which is coupled to the rear end of the impeller shaft 10, and a compressor impeller 18, which is coupled to the front end of the impeller shaft 10.

The turbine impeller 17 is arranged in the turbine housing member 13, and the compressor impeller 18 is arranged in the compressor housing member 15. The turbine impeller 17 and the compressor impeller 18 are coupled to each other by the impeller shaft 10. Thus, the turbine impeller 17, the impeller shaft 10, and the compressor impeller 18 rotate integrally.

Further, the turbocharger 11 has a turbine chamber 13*a*, which accommodates the turbine impeller 17, an exhaust outlet 13*b*, and a turbine scroll passage 13*c*. The turbine chamber 13*a* and the turbine scroll passage 13*c* are located in the turbine housing member 13. The exhaust outlet 13*b* extends in the axial direction and communicates with the turbine chamber 13*a*. The turbine scroll passage 13*c* has a spiral shape extending along the outer circumference of the turbine impeller 17.

The compressor housing member 15 includes a cylindrical peripheral wall 34 and a spiral passage wall 35 located radially outward of the peripheral wall 34. The turbocharger 11 has a compressor chamber 15*a*, which accommodates the compressor impeller 18. The compressor chamber 15*a* is located in the vicinity of the rear end of the peripheral wall 34, and the intake port 15*b* is located in the vicinity of the front end of the peripheral wall 34. The peripheral wall 34 has a central axis. The central axis of the bearing housing member 12 and the central axis of the peripheral wall 34 agree with the central axis L of the impeller shaft 10. The intake port 15*b* communicates with the compressor chamber 15*a*.

Figure 4:
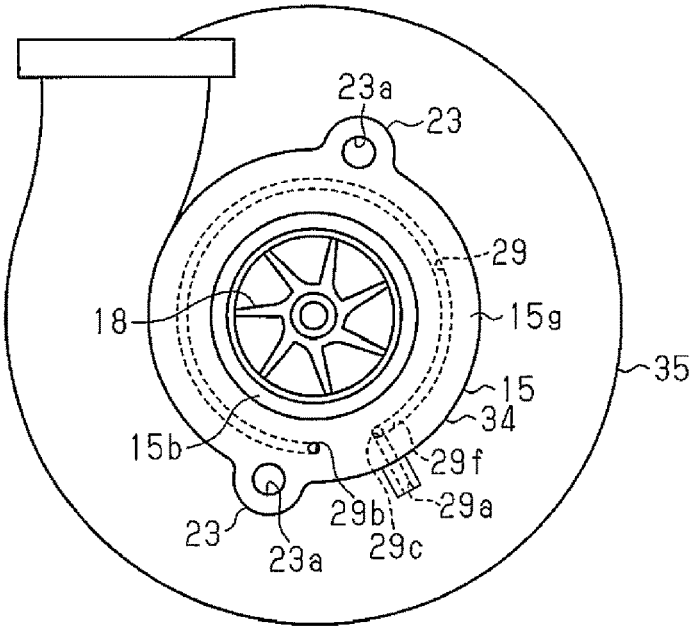
FIG. 4 is a front view of the turbocharger as viewed from the compressor housing member.

As shown in FIGS. 1 and 4, the front end face of the peripheral wall 34, that is, an end face of the opening that surrounds the intake port 15*b* is a connecting end face 15*g*. The peripheral wall 34 has bosses 23 on the outer circumference of the connecting end face 15*g*. The bosses 23 each have internal thread hole 23*a*, which opens in the connecting end face 15*g*.

As shown in FIG. 1, the turbocharger 11 has a compressor scroll passage 20 inside the passage wall 35. The compressor scroll passage 20 has a spiral shape extending along the outer circumference of the compressor chamber 15*a*. The turbocharger 11 has a diffuser passage 21 between the rear end face of the peripheral wall 34 and the seal plate 14. The diffuser passage 21 has an annular shape that surrounds the compressor chamber 15*a*. The diffuser passage 21 compresses air that has been taken in through the intake port 15*b*, thereby increasing the pressure of the air. The peripheral wall 34 has a diffuser surface 15*f*, which faces the diffuser passage 21.

Figure 2:
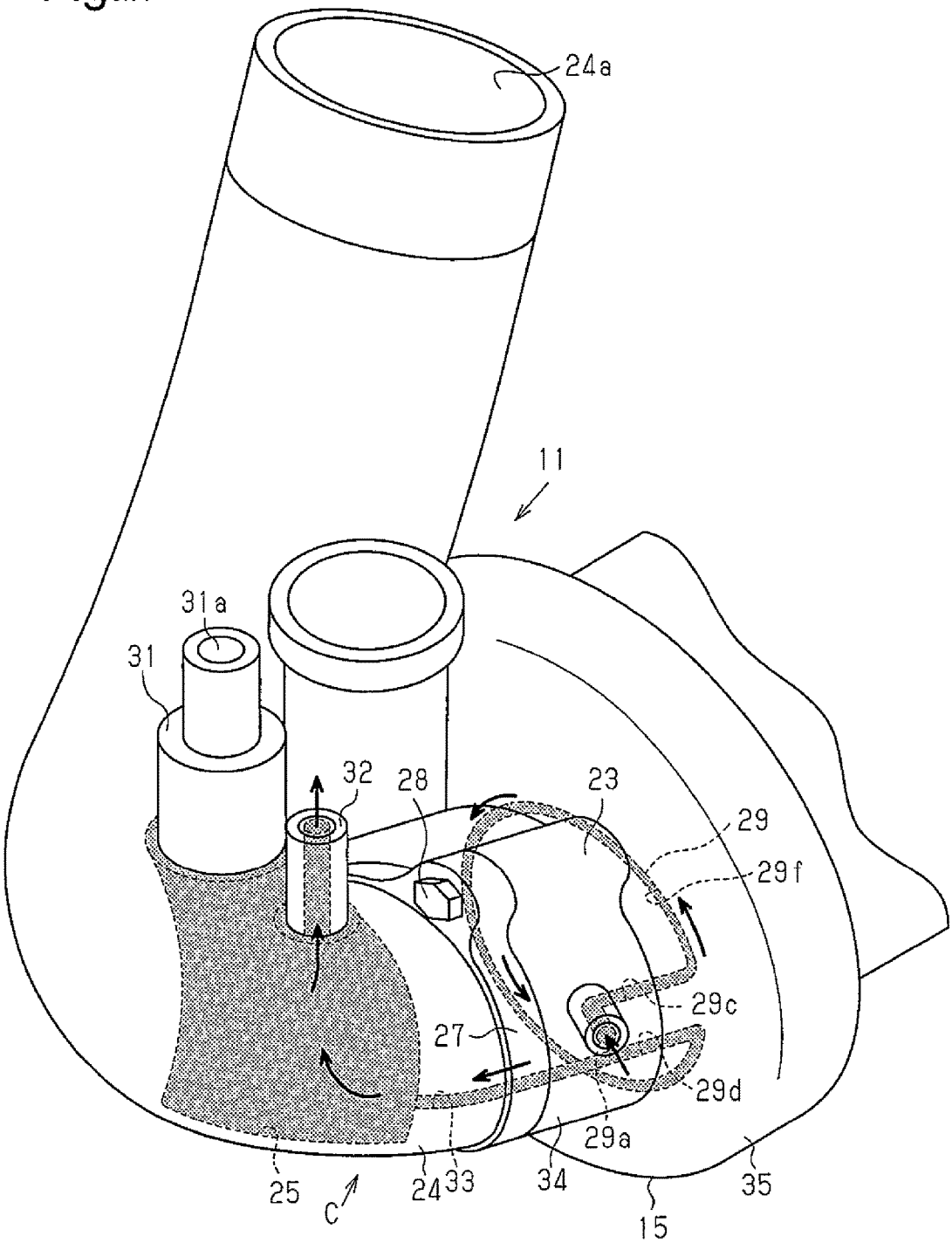
FIG. 2 is a perspective view of the turbocharger.

As shown in FIGS. 1, 2, and 4, the compressor housing member 15 has a nearly circular C-shaped cooling passage 29. The cooling passage 29 extends along the diffuser passage 21. The cooling passage 29 includes an introduction passage 29*c* in the vicinity of an inlet 29*a* for coolant. The introduction passage 29*c*, which is a part of the cooling passage 29, includes a straight section, which extends from the inlet 29*a* in the radial direction, and a section that extends toward the diffuser passage 21 along the central axis of the peripheral wall 34.

The cooling passage 29 includes an outlet 29*b* for coolant at a position below the inlet 29*a*. The outlet 29*b* of the cooling passage 29 is located in the connecting end face 15*g* of the compressor housing member 15. The cooling passage 29 has an outlet passage 29*d* in the vicinity of the outlet 29*b*. The outlet passage 29*d*, which is a part of the cooling passage 29, linearly extends from the C-shaped part of the cooling passage 29, to the connecting end face 15*g*. The cooling passage 29 has a passage main portion 29*f*, which is the C-shaped section connecting the introduction passage 29*c* and the outlet passage 29*d* to each other. The passage main portion 29*f* extends substantially along the entire length of the diffuser passage 21. Coolant for cooling the internal combustion engine flows through the cooling passage 29. Coolant that has flowed from the inlet 29*a* through the introduction passage 29*c*, the passage main portion 29*f*, and the outlet passage 29*d* is conducted out from the cooling passage 29 from the outlet 29*b*. The coolant flowing through the passage main portion 29*f* cools the diffuser surface 15*f*, which spreads along the diffuser passage 21.

As shown in FIG. 1, the intake port 15*b* communicates with the diffuser passage 21 via the compressor chamber 15*a*. The diffuser passage 21 communicates with the compressor scroll passage 20. The compressor scroll passage 20 communicates with an outlet (not shown). The connecting end face 15*g* of the compressor housing member 15 is connected to an intake pipe 24 via a plate-shaped sealing member 19. An intake passage 24*a* is provided in the intake pipe 24.

Figure 3:
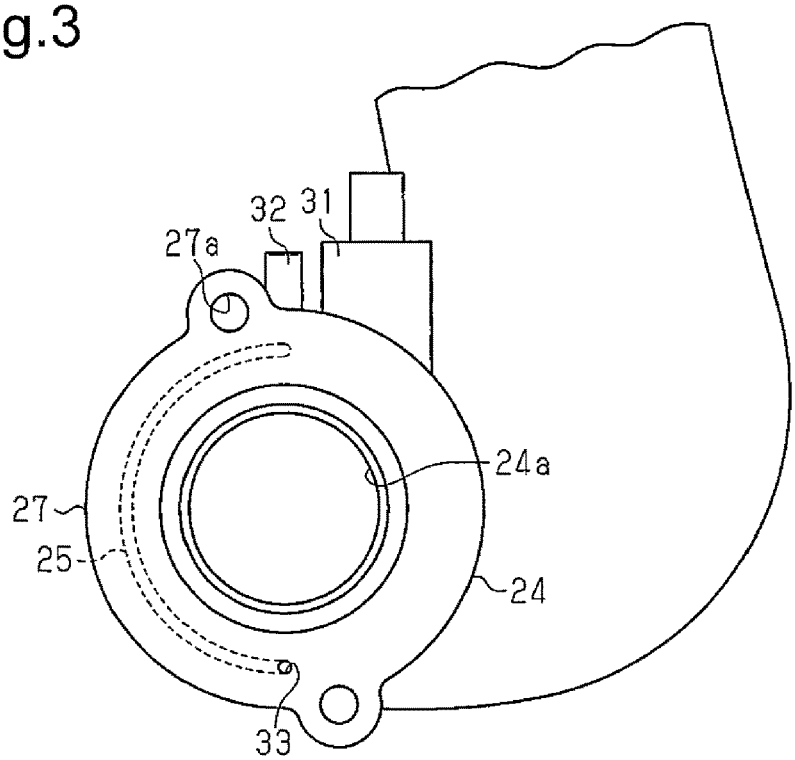
FIG. 3 is a diagram illustrating the intake pipe and the water jacket.

As shown in FIG. 3, the intake pipe 24 has a connection flange 27, which is connected to the compressor housing member 15. The connection flange 27 has bolt insertion portions 27*a*. Bolts 28 are passed through the bolt insertion portions 27*a* and threaded to the internal thread holes 23*a* of the compressor housing member 15. This connects the intake pipe 24 to the compressor housing member 15 so that the intake port 15*b* and the intake passage 24*a* communicate with each other. The gap between the connecting end face 15*g* of the compressor housing member 15 and the connection flange 27 of the intake pipe 24 is sealed with the sealing member 19 in a liquid-tight manner.

As shown in FIGS. 2 and 3, the intake pipe 24 has a water jacket 25 in the outer circumference of the intake passage 24*a*. The water jacket 25 serves as a heating passage. Some of the coolant for cooling the internal combustion engine flows through the water jacket 25. The intake pipe 24 is connected to a blow-by gas pipe 31. The blow-by gas pipe 31 has therein a blow-by gas recirculation passage 31*a*. This connects the intake passage 24*a* and the blow-by gas recirculation passage 31*a* to each other. In the direction of air flowing in the intake passage 24*a*, the water jacket 25 is located on the downstream side of the connection portion between the intake passage 24*a* and the blow-by gas recirculation passage 31*a*.

The blow-by gas pipe 31 is connected to the crankcase of the internal combustion engine. The blow-by gas delivered to the crankcase is conducted to the intake passage 24*a* via the blow-by gas recirculation passage 31*a*. The blow-by gas conducted into the intake passage 24*a* is mixed with the air drawn in through the intake port 15*b*.

A communication passage 33 is provided in the wall of the intake pipe 24. The front end of the communication passage 33 communicates with the water jacket 25, and the rear end of the communication passage 33 is open in the end face of the connection flange 27. The rear end of the communication passage 33 constitutes a coolant inlet of the water jacket 25. The inlet of the communication passage 33 communicates with the outlet 29*b* of the cooling passage 29, which opens in the connecting end face 15*g*. This connects the water jacket 25 and the cooling passage 29 to each other. The water jacket 25 is arranged to surround the connection portion between the blow-by gas recirculation passage 31*a* and the intake passage 24*a*, that is, the proximal end of the blow-by gas pipe 31. The water jacket 25 also ranges over half the circumference of the intake pipe 24. The coolant flowing through the water jacket 25 warms the connection portion between the blow-by gas recirculation passage 31*a* and the intake passage 24*a* and the area about the connection portion. An outlet pipe 32 is connected to the upper portion of the water jacket 25. The coolant is conducted out of the water jacket 25 via the outlet pipe 32.

Operation of the turbocharger 11 will now be described with reference to FIG. 1.

As shown in FIG. 1, exhaust gas discharged from the internal combustion engine is delivered to the turbine scroll passage 13*c* via the exhaust gas inlet (not shown) of the turbine housing member 13. The exhaust gas is drawn into the turbine chamber 13*a* while swirling about the turbine impeller 17 in the turbine scroll passage 13*c*. The introduction of the exhaust gas into the turbine chamber 13*a* rotates the impeller shaft 10. After rotating the impeller shaft 10, the exhaust gas is discharged through the exhaust outlet 13*b* of the turbine housing member 13. The exhaust gas is the purified by the exhaust gas purification device and released to the atmosphere.

The turbine impeller 17 is coupled to the compressor impeller 18 via the impeller shaft 10. Thus, rotation of the turbine impeller 17 rotates the compressor impeller 18. When the compressor impeller 18 rotates, air is drawn into the compressor chamber 15*a* via the intake passage 24*a* and the intake port 15*b* and is then delivered to the diffuser passage 21. At this time, blow-by gas is also drawn into the diffuser passage 21 via the intake port 15*b*. The drawn air is compressed by flowing through the diffuser passage 21. The compressed air flows through the compressor scroll passage 20 and is supplied to the internal combustion engine via the outlet (not shown).

The coolant of the internal combustion engine is drawn into the cooling passage 29 via the inlet 29*a*. Thereafter, the coolant flows through the introduction passage 29*c*, the passage main portion 29*f*, and the outlet passage 29*d*, and is then conducted out from the cooling passage 29 through the outlet 29*b*. The coolant flows from the outlet 29*b* into the water jacket 25 via the communication passage 33. Some of the coolant that has flowed through the water jacket 25 is conducted out from the outlet pipe 32.

The above described embodiment has the following advantages.

(1) The compressor housing member 15 has the cooling passage 29 for cooling the diffuser surface 15*f*. The intake pipe 24 has the water jacket 25 for warming blow-by gas. The cooling passage 29 and the water jacket 25 communicate with each other. After flowing through the cooling passage 29, coolant flows through the water jacket 25. This configuration allows the coolant to cool the diffuser surface 15*f*, thereby lowering the temperature of the diffuser surface 15*f*. Accordingly, the temperature of the diffuser surface 15*f* is kept lower than the temperature at which oil and the like are solidified. This limits solidification of oil and the like on the diffuser surface 15*f*. When flowing through the cooling passage 29, the coolant is heated by compressed air. Accordingly, the temperature of the coolant that flows from the cooling passage 29 into the water jacket 25 is increased above the coolant temperature before being drawn into the cooling passage 29. The coolant, the temperature of which has been increased, warms the connection portion between the intake passage 24*a* and the blow-by gas recirculation passage 31*a* and the area about the connection the portion. This restrains water vapor in the blow-by gas drawn into the intake passage 24*a* from freezing. Therefore, the coolant that flows through the cooling passage 29 and the water jacket 25 can be used to limit both solidification of oil and the like and freezing of water vapor. Further, solidification of oil and the like is limited by the coolant before the temperature thereof is increased, and freezing of water vapor is limited by the coolant after the temperature thereof has been increased. Solidification of oil and the like and freezing of water vapor can therefore be effectively limited.

(2) The communication passage 33 connects the cooling passage 29 and the water jacket 25 to each other. This configuration connects the coolant circuit that limits solidification of oil and the like and the coolant circuit that limits freezing of water vapor to each other to constitute a single circuit. Thus, compared to a case in which a coolant circuit that limits solidification of oil and the like and a coolant circuit that limits freezing of water vapor are independent from each other, the number of pipes required in the turbocharger 11 is reduced. Also, the size of the turbocharger 11 is not increased.

(3) The compressor housing member 15 has the outlet 29*b*, which communicates with the cooling passage 29 and opens in the connecting end face 15*g*. Also, the intake pipe 24 has the inlet of the communication passage 33, which communicates with the water jacket 25 and opens in the connection flange 27. By simply connecting the intake pipe 24 to the compressor housing member 15, the cooling passage 29 is connected to the water jacket 25, so that the cooling passage 29 and the water jacket 25 are continuous with each other. This configuration reduces the number of components compared to a case in which the outlet 29*b* of the cooling passage 29 and the inlet of the communication passage 33 are connected to each other by a pipe.

(4) The inlet 29*a* of the cooling passage 29 is located in a lower portion of the compressor housing member 15, and the outlet 29*b* of the cooling passage 29 is located below the inlet 29*a*. This allows the passage main portion 29*f* of the cooling passage 29 to have a nearly circular C-shape. The passage main portion 29*f* thus extends substantially along the entire length of the diffuser passage 21. Therefore, the diffuser surface 15*f* can be substantially entirely cooled by the coolant.

(5) Coolant for cooling the internal combustion engine flows through the cooling passage 29 and the water jacket 25. Air the temperature which has been increased to approximately 200° C. flows along the diffuser surface 15*f*. The temperature of the coolant is between 80° C. and 100° C. Therefore, the coolant effectively cools the diffuser surface 15*f*. Also, when flowing through the water jacket 25, the coolant the temperature of which has been increased beyond the range between 80° C. and 100° C. effectively limits freezing of water vapor.

(6) In the direction of air flowing in the intake pipe 24, the water jacket 25 is located on the downstream side of the connection portion between the intake passage 24*a* and the blow-by gas recirculation passage 31*a*. Thus, the water jacket 25 warms the blow-by gas immediately after the blow-by gas is drawn in, thereby effectively limiting freezing of water vapor contained in the blow-by gas.

The above described embodiment may be modified as follows.

In the illustrated embodiment, the cooling passage 29 extends substantially over the entire length of the diffuser passage 21. However, the cooling passage 29 may extend only along a part of the diffuser passage 21.

The positions of the inlet 29*a* and the outlet 29*b* of the cooling passage 29 may be changed as necessary. In such a case, the position of the communication passage 33 only needs to be changed in accordance with the outlet 29*b* of the cooling passage 29.

As long as the water jacket 25 can warm the connection portion between the blow-by gas recirculation passage 31*a* and the intake passage 24*a* and the area about the connection the portion, the water jacket 25 may be arranged to surround the entire circumference of the intake passage 24*a* or to surround the connection portion and the area about the connection portion.

The fluid that flows through the cooling passage 29 and the water jacket 25 does not necessary need to be coolant, but may be oil or air.

In the illustrated embodiment, the water jacket 25 is employed as the heating passage. However, a pipe that is separate from the intake pipe 24 may be arranged on the outer circumference of the intake pipe 24 to serve as a heating passage.

The invention claimed is:

1. A turbocharger comprising:

a compressor housing member having a compressor chamber;

a compressor impeller accommodated in the compressor chamber;

an intake port, which communicates with the compressor chamber;

a diffuser passage, which communicates with the compressor chamber and has a shape surrounding the compressor chamber;

a diffuser surface, which faces the diffuser passage;

a cooling passage, which extends along the diffuser surface, wherein a fluid for cooling the diffuser surface flows through the cooling passage;

an intake passage, which communicates with the intake port;

a blow-by gas recirculation passage for drawing in blow-by gas to the intake passage; and a heating passage, which is provided at a connection portion between the blow-by gas recirculation passage and the intake passage, wherein a fluid for warming the blow-by gas flows through the heating passage, wherein the cooling passage communicates with the heating passage, and the fluid that has been drawn into the cooling passage flows to the heating passage after flowing through the cooling passage.

2. The turbocharger according to claim 1, wherein the compressor housing member includes a connecting end face, which surrounds the intake port, the cooling passage includes an outlet, which is located in the connecting end face, the intake passage is located in an intake pipe, the intake pipe includes a connection flange, which is connected to the connecting end face, the heating passage includes an inlet, which is located in the connection flange, and the cooling passage and the heating passage communicate with each other at a connection portion between the connecting end face and the connection flange.

3. The turbocharger according to claim 1, wherein the cooling passage extends along the diffuser passage and has a nearly circular C-shape.

4. The turbocharger according to claim 1, wherein the fluid is coolant of an internal combustion engine.

5. The turbocharger according to claim 1, wherein, in a direction of air flowing in the intake passage, the heating passage is located on a downstream side of the connection portion between the intake passage and the blow-by gas recirculation passage.

* * * * *